US005087343A

United States Patent [19]

Woodson et al.

[11] Patent Number: 5,087,343

[45] Date of Patent: Feb. 11, 1992

[54] ELECTROLYTIC CELL HEADS COMPRISED OF BULK POLYMERIZED CYCLOOLEFIN MONOMERS

[75] Inventors: Charles S. Woodson, Conroe, Tex.; Dennis Janda; Paul T. Stricharczuk, both of Brecksville, Ohio

[73] Assignees: The BF Goodrich Company, Brecksville, Ohio; PTI/END/CORR, Baton Rouge, La.

[21] Appl. No.: 534,708

[22] Filed: Jun. 8, 1990

[51] Int. Cl.[5] ..... C25B 9/00; C25C 7/00

[52] U.S. Cl. ..... 204/242; 204/275; 204/278; 204/279

[58] Field of Search ..... 204/242, 279, 278, 275-277

[56] References Cited

U.S. PATENT DOCUMENTS

| | | | |
|---|---|---|---|
| 2,816,070 | 12/1957 | Buchanan | 204/279 |
| 3,401,109 | 9/1968 | Anderson | 204/279 X |
| 3,763,083 | 10/1973 | Grotheer | 204/279 X |
| 3,847,783 | 11/1974 | Giacopelli | 204/242 X |
| 4,025,401 | 5/1977 | Fujiwara et al. | 204/98 |
| 4,436,609 | 3/1984 | Sobieniak | 204/279 X |
| 4,632,739 | 12/1986 | LaValley | 204/279 X |

*Primary Examiner*—Donald R. Valentine

*Attorney, Agent, or Firm*—Millen, White & Zelano

[57] ABSTRACT

A molded, one piece electrolytic cell head is provided which is obtained from a closed mold. The structure weighs more than 100 pounds and is comprised of bulk polymerized monomers having norbornene functionality. The structure provides improved performance over cell heads comprised of fiber glass reinforced polyester since fiber reinforcement is not required.

13 Claims, 2 Drawing Sheets

ELECTROLYTIC CELL HEADS COMPRISED OF BULK POLYMERIZED CYCLOOLEFIN MONOMERS

BACKGROUND OF THE INVENTION

Electrolytic production of chlorine and caustic soda (sodium hydroxide) began in the late 1800's when the industrial revolution required an efficient source of these materials. Production advances in the 1900's increased output, reduced unit costs and improved quality. Many industrial activities, such as the making of polyvinylchloride, paper, aluminum and textiles, depend on the properties of chlorine and caustic soda to obtain quality products. Chlorine and caustic soda are produced by the electrolysis of salt (sodium chloride). Different types of electrolytic cells are used commercially, the most common being diaphragm cells. All work on the principle of passing electrical energy through a brine solution to generate chlorine gas at an anode and hydrogen gas, with caustic soda, at a cathode. In the case of diaphragm cells, asbestos or polymeric diaphragm(s) serve to separate the anode(s) and cathode(s) within the cell. Both the brine solution and products produced are very corrosive and as such, the materials used in constructing electrolytic cells are often determined by their expected lifetimes. The diaphragms generally last about one year, requiring replacement. The need to replace components of the diaphragm cells necessitates a design which provides access to these components. A design quite common in the industry is one wherein the anodes, cathodes and brine solution are housed in a receptacle, typically comprised of concrete, over which a cover or cell head comprised of fiber glass reinforced polyester is positioned to provide a liquid-tight and gas-tight cavity for the anodes and cathodes. A liquid-tight seal between the cell head and the concrete base is required in that the brine solution is typically maintained at a level above the top of the concrete receptacle so as to cover the anodes and cathodes with brine solution. The cell head must provide a gas-tight seal over the anodes and cathodes so as to prevent the loss of the chlorine and hydrogen gas generated.

Cell heads comprised of fiber glass reinforced polyester (FRP cell heads) have provided good service; however, improvements are desired. Due to the corrosive nature of the electrolytic cell environment, it is necessary to reline the FRP cell heads periodically and eventually replace the cell head. The fiber reinforcement tends to provide a "wick" for the corrosive material such as chlorine and caustic soda, allowing the corrosive material to penetrate the surface causing damage which cannot be repaired. In that a number of electrolyte cells are typically operated in series within a chlor-/alkali plant, relining and replacement is expensive. A more durable cell head is desired.

The FRP cell heads are also difficult to manufacture, requiring a significant amount of manual labor in laying up the fiber glass reinforcement and applying the resin matrix. A cell head made by a more efficient method is also desired.

SUMMARY OF THE INVENTION

The present invention is directed to an electrolytic cell head comprised of bulk polymerized monomers having norbornene functionality. These monomers are polymerized within a closed mold which defines the shape of the electrolytic cell head. This manufacturing method makes the use of fiber reinforcement an option. Preferred embodiments do not utilize fiber reinforcement for the reasons discussed above.

The bulk polymerized norbornene functional monomers provide excellent chemical resistance and the lifetime of the electrolytic cell head will exceed that of FRP cell heads. In addition, the electrolytic cell heads of the present invention need not be relined. It has been found that this molding/bulk polymerization procedure will provide a one piece integrated structure with all the essential features of a cell head. The molding procedure used to produce the electrolytic cell heads allows for a number of preferred features to be integrated into the one piece structure. The bulk polymerized norbornene functional monomers are also well suited to accept additives such as flame retardants, fillers, impact modifiers, antioxidants, etc., providing more versatile cell heads. The electrolytic cell heads provided by this invention are also repairable and can be cut or machined to provide desired elements such as tube flanges, receptacles, equipment supports, etc.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

The invention relates to an electrolytic cell head that is molded in a closed mold to provide a one piece structure. The electrolytic cell heads of this invention weigh more than 100 lbs., and can weight more than 250 or 500 lbs. Bulk polymerizing monomers with norbornene functionality within a mold has been found to be an effective method for making these electrolytic cell heads, despite their large size.

The molded electrolytic cell heads of this invention have a wall thickness preferably in excess of ¼ inch and most preferably ⅜ to 1 inch. Portions of the molded electrolytic cell heads may be as thick as two inches or more.

Figure 1:
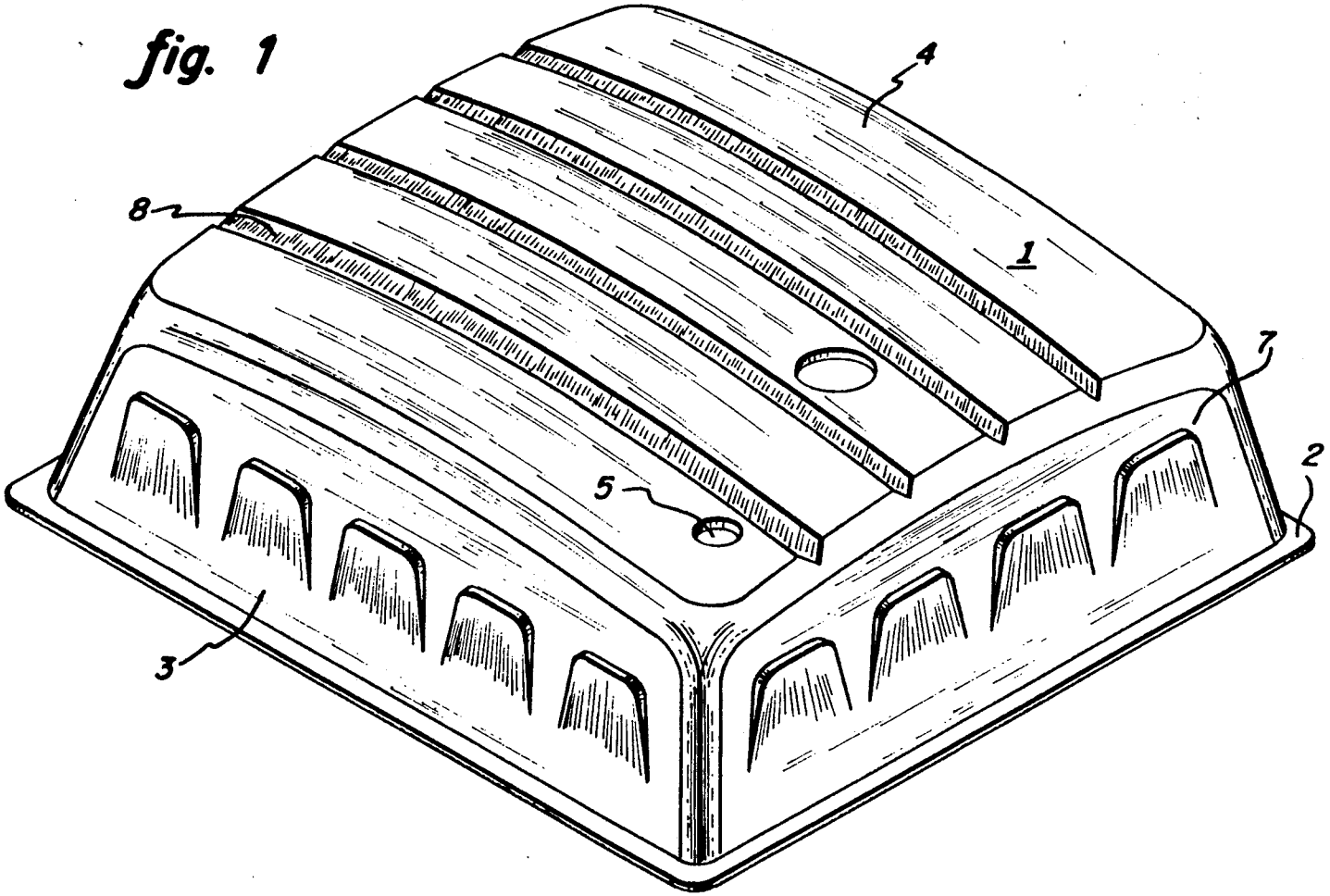
FIG. 1 is a perspective view of an electrolytic cell head of the present invention.

The molding methods used allow for the manufacture of electrolytic cell heads of many configurations. Cell heads for essentially any electrolytic diaphragm cell can be produced. The embodiments shown in FIGS. 1 and 2 have distinct configurations. Cell head 1 of FIG. 1 is a design which does not contain many preferred features integrated into the structure. Cell head 1 comprises flanged base 2 which is adapted to help provide a liquid-tight seal between the electrolytic cell head and receptacle which retains the anode and cathode. A gasket is typically necessary to help accomplish this function. Cell head 1 also comprises side walls 3 and top portion 4. Side walls 3 extend from the flanged base 2 and support top portion 4. Side walls 3 and top portion 4 are slightly corrugated, which is not required. Corrugation is provided in top portion 4 by the presence of grooves 8 and corrugation is provided in the side walls 3 by dimples 7.

Flanged base 2, side wall 3 and top portion 4 are integrally connected to provide a sealed cavity for the anode and cathode of an electrolytic cell when installed. This sealed cavity is water-tight and gas-tight when all orifices are closed or connected to a closed conduit system.

Electrolytic cell head 1 shows a large orifice 5 and small orifice 6 positioned in top portion 4. Large orifice 5 allows for the release of chlorine and hydrogen gas produced by the electrolytic cell when installed. Its cross-sectional area is sufficiently large to provide such release. More than one orifice may be used to accomplish this purpose in the alternative. Small orifice 6 allows for the introduction of brine solution into the electrolytic cell. Small orifice 6 is optional in that it is contemplated electrolytic cells can be designed to allow feeding of the brine solution below the cell head. More than one orifice may be used to accomplish this purpose as well.

The shape of flanged base 2, side walls 3 and top portion 3 are essentially defined by the configuration of the closed mold. Orifice 5 (and orifice 6) need not be defined by a closed mold. Orifice 5 (and orifice 6) may be provided by cutting the molded article.

Figure 2:
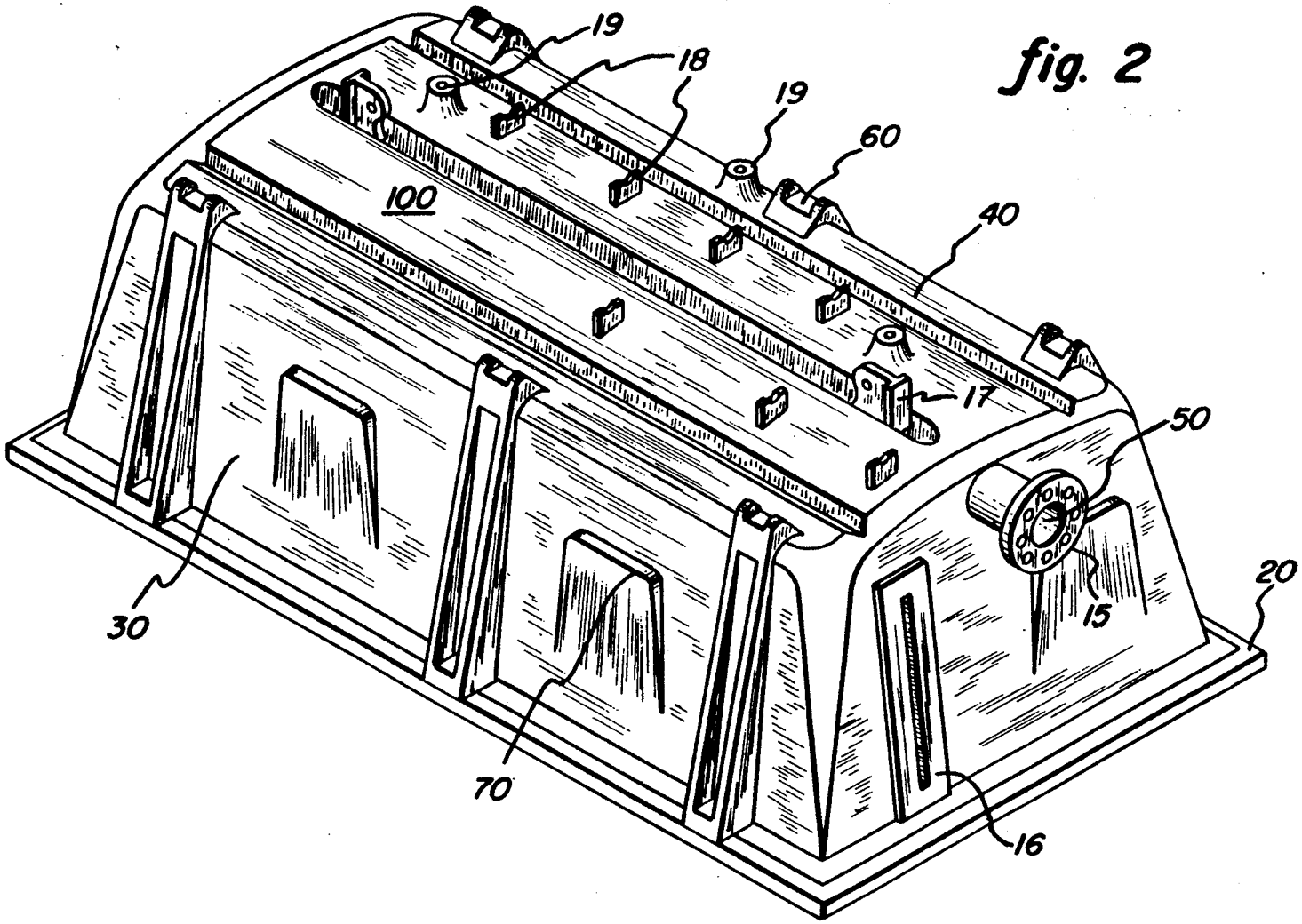
FIG. 2 is a perspective view of another electrolytic cell head of the present invention having preferred elements integrated therein.

FIG. 2 shows a preferred embodiment of the invention. Electrolytic cell head 100 has the essential features including flanged base 20, side walls 30, top portion 40 and orifice 50, and preferred features, such as corrugation in the side walls 30 and top portion 40. Corrugation is provided in top portion 40 by grooves 80 and dimples 70 provide slight corrugation in side walls 30.

Additional preferred features found in electrolytic cell head 100 are brine solution inlets 19 and conduit supports 18. In addition, lifting tabs 17 are positioned in top portion 40 and clamp stabilizers 60 are integrated into side walls 30 to stabilize clamps which anchor electrolytic cell head 100 in place when installed. Orifice 50 is positioned within conduit connector 15, which is incorporated into a side wall 30 near top portion 40. More than one conduit connector 15 with orifice 50 may be incorporated in the structure. Also incorporated in a side wall 30 is a support for a sight gauge. Sight gauge support 16 permits installation of a sight gauge on the side wall which allows the liquid level within an operating electrolytic cell to be viewed. Conduit connector 15 allows for air-tight connection to a conduit system which transports the gases produced from the electrolytic cell. Brine solution inlets 19 and tube supports 18 can be incorporated in cell head 100 when it is known what fluids or gases will be circulated or fed into the electrolytic cell through the cell head.

The flanged base 20, side walls 30 and top portion 10 are integrally connected to provide a sealed cavity for the anode and cathode of an electrolytic cell when installed. This sealed cavity will be air-tight and water-tight when conduit connector 15 is connected to a closed conduit system.

The cell heads of the present invention allow for the integration of these preferred features in the structure, but most important, this one piece molded construction allows for the manufacture of cell heads which do not contain reinforcement fibers. Adequate cell wall thickness can be provided so that fiber reinforcement is not required to provide strength and the method of manufacture does not necessitate the use of fiber reinforcement. However, if desired, fiber reinforcement can be positioned in the mold prior to fill, provided the fiber reinforcement does not interfere with the bulk polymerization of the norbornene functional monomers.

The electrolytic cell heads of the present invention are comprised of a bulk polymerized monomer having norbornene functionality. These monomers are sufficiently low in viscosity so that the large molds necessary can be easily filled. The gel time (time at exotherm) of the reactive formulation with these monomers can be controlled to allow for slow fill of the mold under laminar flow at a rate of 2–8 lbs. per second or higher, using multiple mix heads. Gel times in excess of 5–30 minutes are easily accomplished at temperatures of about 30° C. It is necessary that the mold not be filled under turbulent flow so that bubbles do not form, which causes voids in the finished part. It is also necessary that the formulation be degassed to avoid the formation of bubbles during molding. Molding is generally accomplished with no back pressure or minimal internal mold pressure (a pressure of less than 10 psi) which allows gases within the formulation to expand and coalesce.

Bulk polymerization of the norbornene functional monomers is initiated at a relatively low temperature and the exotherm is relatively short, allowing for the use of plastic molds in manufacturing the electrolytic cell heads of this invention. The plastic molds are less costly than metal molds, making the molding of small numbers of electrolytic cell heads economically feasible. In utilizing the reactive formulations, it is preferred to purge the mold with nitrogen to avoid contamination of the catalyst therein.

In addition to the processing advantages in providing electrolytic cell heads comprised of bulk polymerized norbornene functional monomer, there are advantages in utility as well. The electrolytic cell heads show good dimensional stability, chemical resistance and strength.

The monomers having norbornene functionality that can be polymerized in bulk are characterized by the presence of at least one norbornene group identified by the formula below which can be substituted or unsubstituted.

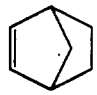

Preferred species are identified by formulas II and III below:

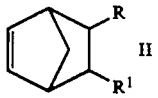

II

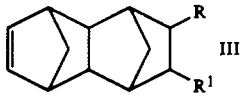

III wherein R and $R^1$ are independently selected from hydrogen, alkyl, aryl groups of 1–20 carbon atoms, and saturated and unsaturated cyclic groups containing 3–12 carbon atoms formed by R and $R^1$ together with the two ring carbon atoms connected thereto.

Examples of monomers having norbornene functionality defined by the formulas above include norbornene, dicyclopentadiene, ethylidene norbornene, dihydrodicyclopentadiene, trimers of cyclopentadiene, tetramers of cyclopentadiene, tetracyclododecene, methyltetracyclododecene, and substituted derivatives thereof such as 5-methyl-2-norbornene, 5-ethyl-2norbornene, 5,6-dimethyl-2-norbornene and similar derivatives.

This invention especially contemplates preparation of homopolymers, copolymers and terpolymers comprising dicyclopentadiene with monomers such as methylnorbornene, ethylidene norbornene, trimers and tetramers of cyclopentadiene and methyltetracyclododecene.

To accomplish bulk polymerization of these monomers within a mold, a suitable metathesis catalyst system is used.

The metathesis catalyst system comprises a catalyst and cocatalyst. Each component can be dissolved in separate streams of the monomer and mixed prior to transfer into the mold cavity. Suitable catalysts include molybdenum and tungsten compound catalysts such as organoammonium molybdates and organoammonium tungstates defined by the formulae below $$[R^2{}_4N]_{(2y-6x)}M_x O_y,\ [R^3{}_3NH]_{(2y-6x)}M_xO_y$$

where O represents oxygen; M represents either molybdenum or tungsten; x and y represent the number of M and O atoms in the molecule based on a valence of +6 for molybdenum, +6 for tungsten and −2 for oxygen; and the $R^2$ and $R^3$ radicals can be the same or different and are selected from hydrogen, alkyl and alkylene groups each containing from 1–20 carbon atoms and cycloaliphatic groups each containing from 5-16 carbon atoms. All of the $R^2$ and $R^3$ radicals cannot be hydrogens.

Specific examples of suitable organoammonium molybdates and organoammonium tungstates include tridodecylammonium molybdates and tungstates, methyltricaprilammonium molybdates and tungstates, tri(tridecyl)ammonium molybdates and tungstates and trioctylammonium molybdates and tungstates. Preferably, from 0.1 to 10 mml of catalyst are used per mole of total monomer. The molar ratio of catalyst to cocatalyst can vary from 200:1 to 1:10.

The cocatalyst comprises an alkyl aluminum or alkyl aluminum halide reacted with an alcohol so as to inhibit the reducing power of the cocatalyst. The reaction is rapid and results in the evolution of volatile hydrocarbons such as ethane, if diethyl aluminum is the cocatalyst. Specific examples of alkylaluminum compounds include ethylaluminum dichloride, diethylaluminum monochloride, ethylaluminum sesquichloride, diethylaluminum iodide, ethylaluminum diiodide, ethylaluminum dichloride and the like.

In providing long gel times for the norbornene functional monomers, it is preferable to react these alkylaluminum compounds with branched or hindered alcohols and more preferable to use combinations of such alcohols with unhindered alcohols. The hindered alcohols include tertiary alcohols, secondary hindered alcohols and primary hindered alcohols. When such alcohols are combined with unhindered alcohols, the temperature necessary to initiate gel in the reactive formulation is reduced. Specific examples of hindered secondary alcohols include 2,4-dimethyl-3-pentanol, 3,5-dimethyl-4-heptanol and 2,4-diethyl-3-hexanol and the like. Specific examples of hindered primary alcohols include neopentyl alcohol, 2,2-dimethyl-l-butanol, 2,2-diethyl-1-butanol and the like. Specific examples of suitable tertiary alcohols include t-butanol, t-amylalcohol, 3-ethyl-3-pentanol and the like.

Primary alcohols and secondary alcohols which can be used in combination with the above hindered alcohols include 2-methyl-1-propanol, 2-ethyl-1-butanol and propanol. Preferably, the hindered alcohols are used in a ratio of about 60:40 hindered versus unhindered and most preferably, 2,4-dimethyl-3-pentanol is used with propanol in such a ratio.

The amount of alcohol which is reacted with the aluminum compound is also indicative of the reducing power of the cocatalyst and preferably a ratio of from 1:1 to 1.25:1 total alcohol to aluminum compound is used.

Where the cocatalyst does not contain any halide, an activator is used to supply halide to the system. This halometal activator makes the system more reactive and tends to shorten pot life. Suitable activators include chlorosilanes such as dimethylmonochlorosilane, dimethyldichlorosilane, tetrachlorosilane and the like. The amount of activator used falls in the range of 0.05 to 10 millimole per mole of norbornene functional monomer and preferably low levels are used to prevent localized exotherms.

Reaction injection molding (RIM), and resin transfer molding (RTM) are forms of bulk polymerization which occur in a closed mold. RIM and RTM differ from thermoplastic injection molding in a number of important respects. Thermoplastic injection molding is conducted at pressures of about 10,000 to 20,000 psi in the mold cavity by melting a solid resin and conveying it into a mold maintained at a temperature below the glass transition temperature of the polymer and the molten resin is typically at a temperature of about 150° C. to 350° C. The viscosity of the molten resin is generally in the range of 50,000 to 1,000,000 cps. In thermoplastic injection molding, solidification occurs in about 10–90 seconds, depending on the size of the part. No chemical reaction takes place in the mold.

In RIM and RTM processes, the viscosity of the materials fed to the mold is about 50–3,000 cps., preferably from 100 to 1,500 cps. at temperatures varying from room temperature to 80° C. At least one component in the RIM or RTM formulation is a monomer that is polymerized to a polymer in the mold. The primary distinction between injection molding and RIM/RTM resides in the fact that in RIM and RTM, a chemical reaction takes place to transform a monomer to a polymeric state.

While most RIM and RTM procedures have resulted in good molding with norbornene functional monomers, difficulties have been experienced when molding large parts. Since the formulation injected into the mold reacts exothermically the heat generated from a large part can cause a fire. Therefore, formulations with low and/or short exotherm are desired. In addition, when molding the large parts, such as those of the present invention, delayed gel times are preferred so the system does not react before the mold is filled. A gel time and time to exotherm in excess of two minutes at 40 C is desired, most preferably in an excess of 10 minutes at temperatures of about 40° C.

When forming parts with such a slow reactive formulation having a delayed gel time it may be desirable to degas the monomer formulations in that any gas bubbles present will coalesce in the mold prior to the initiation of gelation. These gas bubbles will cause surface defects in the molded article Degassing the monomer formulations just prior to mixing and injection into the mold may be desired. The level of dissolved gas in the reaction formulation can be characterized by the head space ratio parameter described below.

Head Space Ratio Parameter

The head space ratio parameter characterizes the amount of dissolved gas within a monomer component. To determine the parameter value for a liquid such as a monomer component, a sample of the component is allowed to stand for at least 15 minutes within a sealed quart container, such as a pop bottle, under a nitrogen blanket or other inert gas at atmospheric pressure. For an accurate test, the volume of liquid component is maintained at 75% of the total volume for the container used. If an approximate value is desired, variations in the volume of liquid component can be used. For example, approximate values were obtained by setting a standard level within a quart pop bottle of 6.25" from a bench top. This is about 75% of the total volume of the pop bottle. If relative measurements are desired, the liquid volume selected must be constant Partially filling the closed container leaves a head space of 25% of the total volume of the closed container. If an accurate measurement is desired, the head space should not be filed with an inert gas expected to be dissolved in the liquid. After standing for over 15 minutes at 25° C., a sample of the head space is withdrawn by syringe and injected into a GC (gas chromatograph). The GC is maintained at 50° C. with a run time of 5 minutes, injection port temp. =250° C., chart speed: 1 cm/min, zero—10, attenuation—16, slope sensitivity—0 and flow rate 20 mls/min.

The relative amounts for each component of the head space are recorded and corrected for thermal conductivity. The relative area of the peaks for gases other than nitrogen (or other inert gas) determines the mole% of dissolved gas which evolved into the head space, which is value used for the head space ratio parameter.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire disclosures of all applications, patents and publications, if any, cited above and below, and of corresponding application, are hereby incorporated by reference.

EXAMPLES

The following components are used in each of examples 1–4. The level of alcohol introduced to component A (cocatalyst component) is varied to provide the different gel time targets. The alcohol:aluminum ratio of the cocatalyst component is indicated in each example.

| Component A.cocatalyst component | weight (lbs.) |
|---|---|
| Dicyclopentadiene (DCPD) | 347.45 |
| Ethylidene norbornene (ENB) | 28.17 |
| Diene 55 polybutadiene | 14.0 |
| 20% n-propanol solution (PrOH) in DCPD/ENB 92.5/7.5 | 5.73 |
| 20% 2,4-dimethyl-3-pentanol (DMPDH) in DCPD/ENB 92.5/7.5 | 1.97 |
| Diethylaluminum chloride (DEAC)-neat | 1.98 |
| Silicon tetrachloride ($SiCl_4$) | 0.7 |

-continued

| Component A cocatalyst component | weight (lbs.) |
|---|---|
| | 400 lbs. |

Component A is formulated in a reactor since the cocatalyst is formed by the reaction of alcohol and DEAC. About 389 lbs. of an DCPD/ENB monomer solution is added to a reactor and maintained under $N_2$ pressure. The remaining components are added in the following order DEAC, DMPOH, PrOH and $SiCl_4$. The DEAC is then mixed in for 10 minutes, following which the alcohols are added. Component A is then degassed by purging with nitrogen through a dip tube at 50 SCFH and 20" Hg vacuum. The reactor is heated to 50° C. and held for 70 minutes, following which cooling water is added. When cooled to 30° C., the $N_2$ purge is turned off. After degassing, $SiCl_4$ is added and mixed for 15 minutes. The component is degassed again at 20" Hg vacuum with slow agitation.

| Component B (catalyst component) | weight (lbs.) |
|---|---|
| Dicyclopentadiene (DCPD) | 342.67 |
| Ethylidene norbornene (ENB) | 27.78 |
| Diene 55 polybutadiene | 14.0 |
| Tris-2,4-dibutylphenyl phosphite, Mark 2112 antioxidants | 6.0 |
| Molybdate Catalyst (48% DCPD/END 92.5/7.5) $[(C_{12}H_{25})_3NH]_4Mo_8O_{26}$ | 3.50 |

About 385 lbs. of a DCPD/ENB monomer mixture is added to a reactor. The other components are then funneled through a valve into the reactor and mixed for 30 minutes. The catalyst component is then degassed for 30 minutes at 20" Hg vacuum with slow agitation.

Both components A and B are stored in epoxy lined drums.

EXAMPLE 1

This example demonstrates the manufacture of an article within the scope of the invention. An electrolytic cell head having a weight in excess of 500 lbs. was made by bulk polymerizing a monomer mixture of dicyclopentadiene and ethylidene norbornene in an epoxy mold. The two monomer components, A and B, comprising the components listed above, were used. The alcohol to aluminum ratio was 1:1.

The cocatalyst component was degassed further by applying a vacuum (about 10" Hg vacuum) for about 60 minutes with a nitrogen purge (200 SFCH $N_2$). This was repeated at 50° C. for 1.5 hours at 15" Hg vacuum and a slow nitrogen stream of 50 SCFH $N_2$. The cocatalyst component provided a head space ratio parameter of approximately 1.3, which was measured by the procedures given above using a quart pop bottle filled 6.25" from the bench top.

Component A and Component B were combined and injected into a mold by the use of a reaction injection molding machine provided by Admiral having a radial piston and gear pump which provided continuous flow.

The mold comprised two epoxy sections, one male section to define the interior of the electrolytic cell head and one female section to define the exterior of the cell head. The mold had a width greater than 5', a length greater than 10' and a height greater than about 4'. The female epoxy section was supported in the steel frame and surrounded by heat transfer coils and insulation.

The male section was similarly constructed. When the two mold sections were assembled, the cavity defined an electrolytic cell head which was upside down. The two mold sections were held together by bolts near the top of each frame. The mold was gated at the bottom, where the top of the electrolytic cell head is defined and a plurality of vents (8) were distributed at the top of the mold, where the flanged base of the electrolytic cell head is defined.

The mixed components were injected from the reaction injection molding machine at a continuous rate of about 4.2 lbs. per second at an injection pressure of about 950 psig. The mold was inclined at about 45° from the floor with the use of a crane to aid in filling.

The mold temperature was about 34° C.±5° C., with variations due to its large size. The injected formulations had a temperature of about 35° C. The temperature of some portions of the mold can be higher than others by heating different sections This is often done to improve the surface at certain portions. Thermocouples were positioned about the mold cavity to monitor temperature increases.

The mold was filled in about 2.9 minutes, which was slightly longer than the calculated 2.6 minutes predicted for a 650 lb. shot. The time to exotherm for the reactive formulation of the mix head was determined to be 9.7 mins. at 47° C. This is believed to correspond to the time to exotherm of 14.25 mins. at the initial material temperature of 35° C. This extrapolation is based on a change in time to exotherm for the formulation shown in Example 2 which follows.

After the mold was filled, rapid exotherm was first detected near a vent at 12 mins. Rapid exotherm at the mix head was detected shortly thereafter (less than 2 mins.). After about 20 mins., efforts were made to demold the part; however, the part stuck to the mold, requiring a few hours to release the part. It was necessary to damage the mold and free the part. However, the part showed no structural defects on molding. Due to the sticking, it was necessary to dislodge the pipe flange mandrel with a sledge hammer, which resulted in a crack in the flange.

Minor voids caused by bubbles appeared in the pipe flange and top portion due to excessive turbulence during fill. This turbulence was caused by an excessive gap between the mix head and retractable piston of the gate (1"), this gap should be in the neighborhood of 0.125".

The example illustrates the difficulties in molding large parts. Except for the damage caused in releasing the part, the electrolytic cell could have been put to use.

EXAMPLE 2

Another part was molded in the same mold using identical equipment. The monomer formulations described above in Example 1 were used. The ratio of total alcohol to diethylaluminum chloride was 1.05:1.

The cocatalyst component was degassed by applying a vacuum (about 15" Hg) for 60 mins. under a nitrogen stream of 200 SCFH $N_2$. This was repeated at 50° C. for 30 mins. at a stream of 50 SCFH $N_2$. The cocatalyst component provided a head space ratio parameter of approximately 3.2, as measured by the procedures given in Example 1.

The mixed components were injected into the gate at a continuous rate of about 4.15 lbs. per second at an injection pressure of about 950 psig. The mold was inclined 20° from the floor with the use of a crane. The mold temperature was about 34° C.±5° C. with the variations caused by the large size of the mold. The initial temperature of the reactive formulation was about 57.2° C. The mold was filled in about 2.4 mins., which was slightly shorter than the 2.6 mins. calculated for a 650 lb. part. The time to exotherm for this formulation out of the mix head was measured to be about 13 mins. at 40° C. and 16.3 mins. at 37.2° C. For these values, it is presumed the exotherm at the initial material temperature of 35° C. was 16.3 mins.

After the mold was filled, a rapid exotherm was first detected at a vent at 13.4 mins. Rapid exotherm near the mix head was detected shortly thereafter (about 2.4 mins.).

After 21 mins. from the initiation of the mold fill, the mold sections were unbolted and, after 45 mins., the part was removed from the mold. The part had a good inner surface. However, voids were created by incomplete venting and bubbles caused by turbulence at the mix head. This turbulence was caused by a large gap between the mix head and the retractable piston of the gate. The gap was 1", whereas it should have been much less.

EXAMPLE 3

An electrolytic cell head suitable for use in industry was made in the same mold using the same equipment described in Example 1. The same monomer mixture and catalyst and cocatalyst components were used as described in Example 1. The cocatalyst was modified slightly in that the ratio of total alcohol to diethylaluminum chloride was 1.115:1. The cocatalyst component A was degassed to provide a head space parameter value of approximately 1.2.

The reactive formulation was fed from the RIM machine into the mold at a rate of about 4.08 lbs. per second and the mold was inclined at an angle of 40° from the floor during fill. The mold temperature was maintained at about 32° to 3820 C. The shot charge targeted was about 660 lbs. and the final part weight was about 570 lbs. A fill time of 162 seconds was calculated. However, injection was stopped after overflow at 150 seconds.

The time to exotherm for the reactive formulation was measured as 9.3 minutes at 40° C. and was presumed to be 14 minutes at the initial material temperature of the reactive formulation, which was about 37° C. Exotherm appeared to occur at a vent after 11 minutes. The bolts were loosened on the mold after 12 minutes and a part was released. The electrolytic cell had good surface characteristics and was good enough to be put in service. The retractable piston was placed 3/32" from the mix head unlike the previous examples and very little excess turbulence resulted. In addition, a mold release agent was used and very little sticking occurred. Where sticking did occur, slight warping resulted but did not effect the structural integrity of the electrolytic cell head produced.

EXAMPLE 4

The mold trial identical to Example 3 was repeated except that the cocatalyst used was modified slightly to provide an alcohol to diethylaluminum chloride ratio of 1.125:1. In addition, the cocatalyst component was degassed to obtain a head space ratio parameter of approximately 0.9.

The process was modified slightly by maintaining the mold at an incline of 7.5° from the floor and the mixture was fed into the mold at 3 lbs. per second.

The electrolytic cell head was released from the mold at about the same time interval as in Example 3. The cell head had no structural defects and an excellent inner surface. Relatively few voids were located on the outside of the cell head. The part was found to be acceptable to be put in service.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A one piece, molded electrolytic cell head weighing more than 100 lbs., wherein said electrolytic cell head is comprised of monomers having norbornene functionality which are bulk polymerized in a closed mold, said electrolytic cell head having (a) a flanged base adapted to help provide a liquid tight seal between said electrolytic cell head and the receptacle which retains the anode and cathode of an electrolytic cell;

(b) side walls which extend from the flanged base;

(c) a top portion supported by said side walls; and (d) at least one orifice positioned in or near said top portion having a cross-sectional area adapted to release the gases produced by the anode and cathode of the electrolytic cell when installed, wherein the flanged base, side walls and top portion are integrally connected to provide a sealed cavity for the anode and cathode of an electrolytic cell when installed, and wherein said sealed cavity is water-tight and gas-tight when all orifices are closed or connected to a closed conduit system.

2. A molded electrolytic cell head as in claim 1 which does not contain fiber reinforcement.

3. A one piece, molded electrolytic cell head weighing more than 100 lbs., which does not contain fiber reinforcement, wherein said electrolytic cell head is comprised of monomers having norbornene functionality which are bulk polymerized in a closed mold by a metathesis catalyst system, said electrolytic cell head having (a) a flanged base adapted to help provide a liquid tight seal between said electrolytic cell head and the receptacle which retains the anode and cathode of an electrolytic cell;

(b) side walls which extend from the flanged base;

(c) a top portion supported by said side walls; wherein said side walls and top portion have a thickness of at least $\frac{1}{4}$"; and (d) at least one orifice positioned in or near said top portion having a cross-sectional area adapted to release the gases produced by the anode and cathode of an electrolytic cell, when installed, wherein the flanged base, side walls and top portion are integrally connected to provide a sealed cavity for the anode and cathode of an electrolytic cell, when installed, and wherein said sealed cavity is water tight and gas tight when all orifices are closed or connected to a closed conduit system.

4. A molded electrolytic cell head as in claim 3, wherein the side walls and top portion are corrugated.

5. A molded electrolytic cell head as in claim 3 wherein lifting tabs, tubing supports, brine solution inlets, conduit connectors and clamp stabilizers are integrated therein.

6. A molded electrolytic cell head as in claim 3, wherein the monomer having norbornene functionality comprises dicyclopentadiene.

7. A molded electrolytic cell head as in claim 6 additionally having a flame retardant additive incorporated therein.

8. A molded electrolytic cell head as in claim 3, wherein the monomer having norbornene functionality is polymerized in bulk with a metathesis catalyst system comprised of a tungsten or molybdenum catalyst with a cocatalyst obtained by reaction of an alkyl aluminum halide and a hindered alcohol comprising 2,4-dimethyl-3-propanol at propanol in a 60:40 ratio and an alcohol to aluminum ratio between 1.0:1.0 and 1.25:1.0.

9. A molded electrolytic cell head as in claim 3 weighing more than 250 lbs.

10. A molded electrolytic cell head as in claim 3 weighing more than 500 lbs.

11. A molded electrolytic cell head as in claim 3, wherein the side walls and top portion have a thickness within the range of $\frac{3}{8}$" to 1".

12. A molded electrolytic cell head as in claim 3, wherein the monomer having norbornene functionality is selected from dicyclopentadiene; trimers and tetramers of cyclopentadiene; dihydrodicyclopentadiene; tetracyclododecene; norbornene; ethylidene norbornene; and mixtures thereof.

13. A molded electrolytic cell head as in claim 3, wherein the orifice is positioned near said top portion within a sidewall.

* * * * *

UNITED STATES PATENT AND TRADEMARK OFFICE

CERTIFICATE OF CORRECTION

PATENT NO. : 5,087,343

DATED : February 11, 1992

INVENTOR(S) : Charles WOODSON et al.

It is certified that error appears in the above-identified patent and that said Letters Patent is hereby corrected as shown below:

Under EXAMPLE 3, Col. 10, Line 38 Delete "3820C"

and insert - - 38°C- -

Signed and Sealed this

Seventh Day of September, 1993

Bruce Lehman

*Attest:*

BRUCE LEHMAN

*Attesting Officer*

*Commissioner of Patents and Trademarks*